United States Patent [19]

Claessens

[11] 4,038,788

[45] Aug. 2, 1977

[54] SLIDING ROOF

[76] Inventor: Willem Maria August Claessens, Schubertstraat 15, Zutphen, Netherlands

[21] Appl. No.: 595,691

[22] Filed: July 14, 1975

Related U.S. Application Data

[63] Continuation of Ser. No. 433,776, Jan. 16, 1974, abandoned.

[30] Foreign Application Priority Data

Jan. 16, 1973 Netherlands ..... 7300641

[51] Int. Cl.[2] ..... E04B 1/345

[52] U.S. Cl. ..... 52/2; 52/15; 52/66

[58] Field of Search ..... 52/64, 66, 2, 15

[56] References Cited

U.S. PATENT DOCUMENTS

| | | | |
|---|---|---|---|
| 2,455,834 | 12/1948 | Ushakoff | 52/2 |
| 3,120,682 | 2/1964 | Reffell | 52/2 |
| 3,151,663 | 10/1964 | Bohner | 160/84 R |
| 3,328,926 | 7/1967 | Reinhard | 52/2 |
| 3,412,509 | 11/1968 | Popil | 52/2 |
| 3,433,470 | 3/1969 | Erke | 52/2 |
| 3,440,776 | 4/1969 | Fraioli | 52/2 |
| 3,552,072 | 1/1971 | O'Connell | 52/2 |
| 3,660,951 | 5/1972 | Cadwell | 52/2 |
| 3,664,069 | 5/1972 | Ikai | 52/2 |
| 3,742,657 | 7/1973 | Price | 52/2 |
| 3,815,299 | 6/1974 | Sorenson | 52/2 |

*Primary Examiner*—John E. Murtagh
*Attorney, Agent, or Firm*—Snyder, Brown & Ramik

[57] ABSTRACT

A sliding roof for use on a building, particularly a sports hall, a swimming pool, the yard of a school or a shopping center, wherein in a supporting structure a plurality of parallel beams are slidably supported, two successive beams are interconnected by two layers of gas-tight cloth, the chambers formed by two beams and two layers of cloth are closed in a gas-tight manner near the ends of the beams, each chamber communicates with a compressor for the supply of a gas, particularly air, to said chamber and means are provided for securing in place the outermost beams with respect to the rims of the opening to be covered.

8 Claims, 4 Drawing Figures

Figure 3:
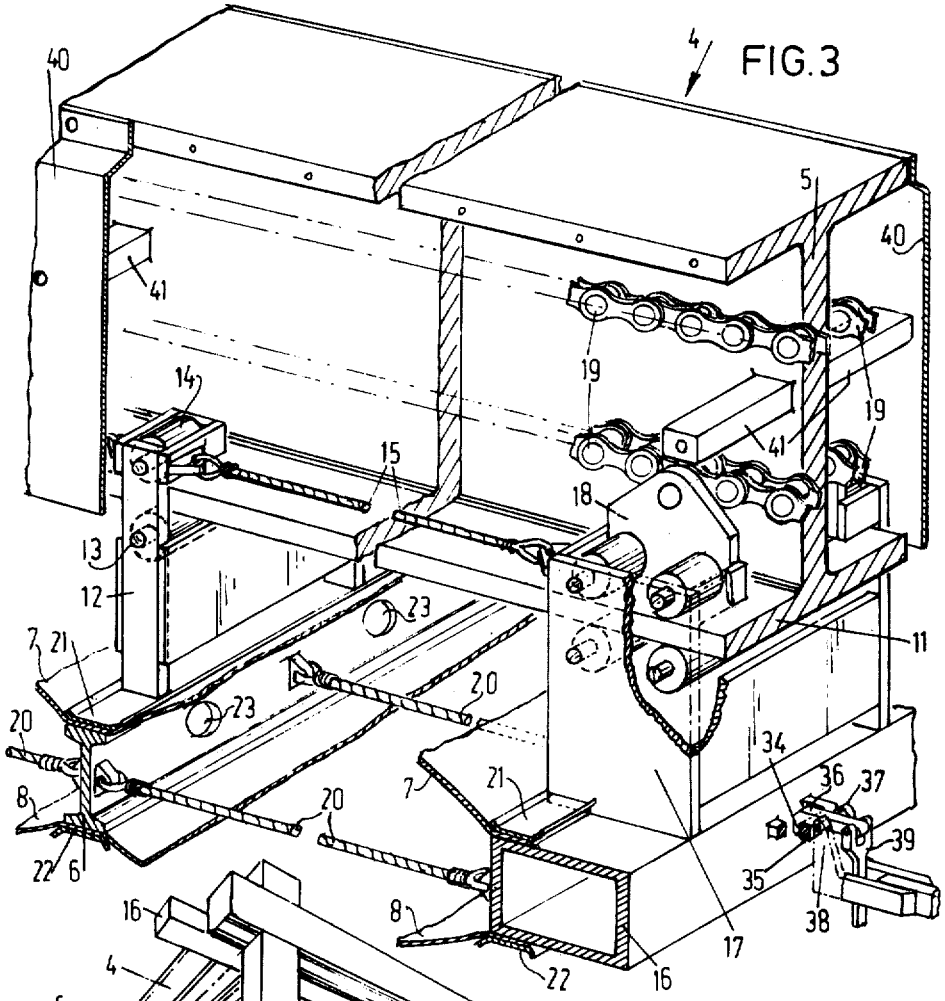

FIG. 1
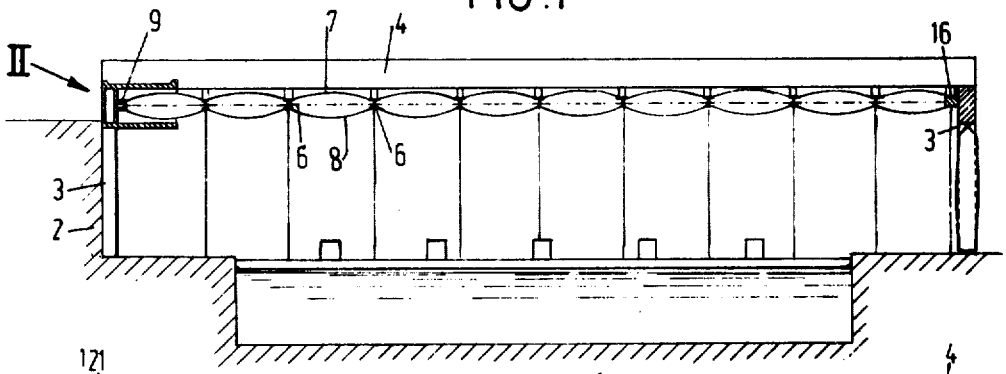
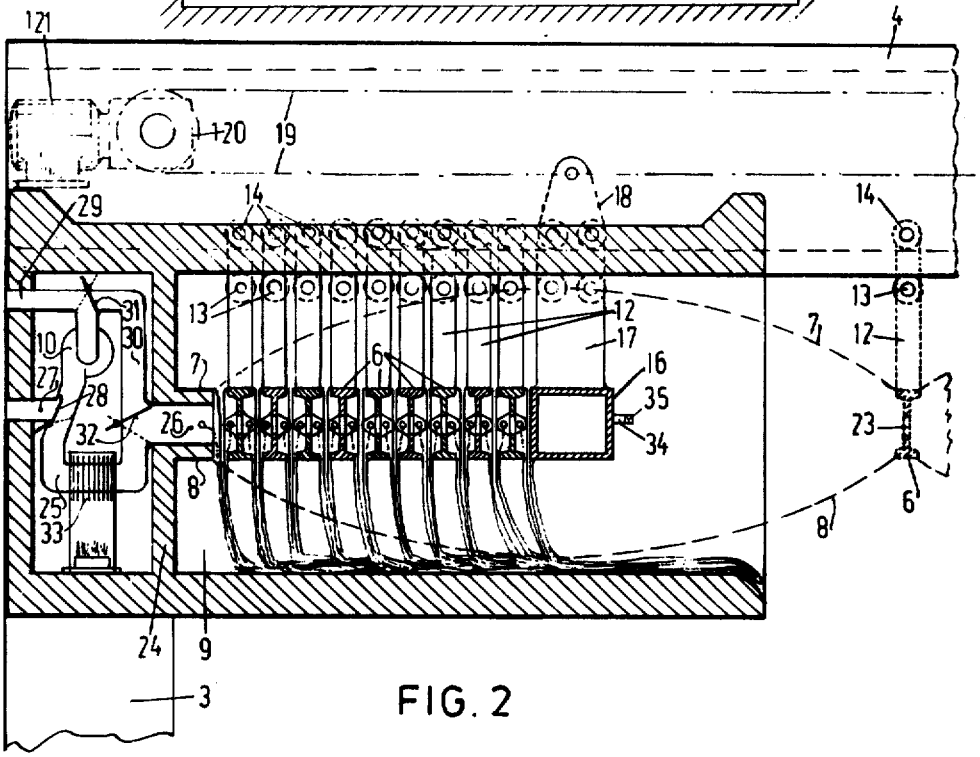
FIG. 2

SLIDING ROOF

This is a continuation of application Ser. No. 433,776, filed Jan. 16, 1974 now abandoned.

The invention relates to a sliding roof for a building, particularly a sports hall, a swimming pool, a yard of a school or a shopping centre.

The invention has for its object to provide a sliding roof of the kind set forth, which can be readily closed and opened and can be made at low cost. According to the invention a supporting structure is provided for this purpose with a plurality of parallel slidable beams, two successive beams being interconnected by two layers of gas-tight cloth, the chambers formed by two beams and two layers of cloth being closed near the ends of the beams in a gas-tight manner, each chamber communicating with a compressor for the supply of a gas, particularly air, to said chamber, whilst means are provided for securing in place the extreme beams with respect to the rims of the opening to be covered. When such a sliding roof is to be closed, the beams are shifted away from each other, after which the chambers formed by two beams and two layers of cloth are filled with a gas. The layers of cloth will bulge inwardly and outwardly and will form a light closure, which has particularly satisfactory insulating properties owing to the stagnant layer of air. The supporting structure may be light and hence cheap. Even if the compressor should fail to operate, the cover is maintained.

According to the invention the slidable beams may be suspended at various points to sets of wheels running along a guide rail, whilst the first slidable beam may be connected by means of a rigid suspension element with the associated set of wheels, which set is connected, in turn, with an uninterrupted cable or chain passed around a reversing roller and extending over at least part of the length of the opening to be covered and being adapted to be driven by a motor, whilst there may be provided means for securing the first beam in the desired position against displacement. Since the first beam is displaced with the aid of the cable or chain, the other beams can be drawn or pushed along according as the roof has to be closed or opened respectively. Since the slidable beams are suspended by sets of wheels to guide rails, they can be readily displaced so that no heavy forces need be exerted on the roof.

According to the invention the chambers may accommodate pulling members, particularly cables, interconnecting the beams forming the boundaries of the chambers. Owing to these pulling members the forces are transferred to the beams, when the roof is opened, through these pulling members without loading the layers of cloth. In the closed state of the roof the pulling members also contribute to the absorption of the forces produced by the pressure of wind.

According to the invention the first slidable beam may be of rigid construction both in a horizontal and a vertical direction, particularly by using a box-shaped profile. The first beam is thus capable of absorbing fairly heavy forces, which may occur when the roof is inflated in the opened state.

According to the invention there may be provided a plurality of locking means, the relatively co-operating parts of which are secured on the one hand to a part rigidly secured to the supporting structure and on the other hand to the slidable beam. With the aid of these locking means the first beam can be fixed in place in a simple manner in the closed state of the roof. The same locking means may also be employed for fixing the beam, when the roof is partially opened.

According to the invention a U-shaped chamber may be provided at the end of the opening to be closed remote from the first beam for receiving the joined beams and the freely hanging layers of cloth. In the opened state of the roof the layers of cloth and the beams are completely withdrawn from sight.

According to the invention the compressor may communicate with the chamber adjacent the fixed end of the sliding roof, whilst openings may be provided in the partition between every two adjacent chambers. The compressor may then be connected with a fixed part of the sliding roof so that despite the displaceable chambers movable ducts are not required.

According to the invention the compressor may communicate with the first chamber through a set of ducts including valves so that the compressor can feed compressed air into the chambers and withdraw it therefrom by means of the valves. Such an embodiment is particularly advantageous for providing the possibility of rapidly opening the roof, since less time is required for removing the air from the chambers.

According to the invention the ducts connected with the compressor for the supply of gas to the chambers may include a heating device. The chambers in the sliding roof may thus be employed for heating the closed space, whilst condensation on the inner side of the roof is avoided. This may be particularly important in the case of a swimming pool.

According to the invention the beams with the intermediate chambers may extend at the ends into a U-shaped guide extending alongside the opening. With such a U-shaped guide a satisfactory closure of the rim of the roof is obtained, whilst vertical forces exerted on the roof can be better absorbed.

According to the invention the supporting beams may be held in a manner such that they are in a slightly inclined position so that a sloping gutter is formed between the top sides of the successive chambers. This is advantageous for draining rain falling on the roof.

Finally, in accordance with the invention, the chambers may be provided on the bottom side at the lowermost point with a tapping opening for condensed water, which can be closed. In this way it is avoided that after some time a considerable quantity of water should be collected in the chambers.

Figure 4:
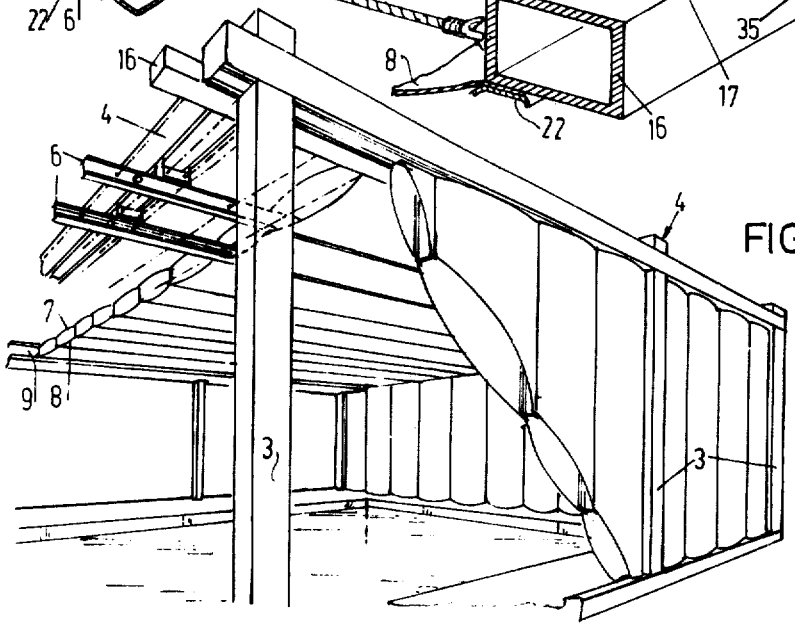

The invention will be described more fully in the following description of an embodiment with reference to the drawing, in which:

FIG. 1 is a schematic sectional view of a swimming pool having a sliding roof in accordance with the invention, FIG. 2 is a sectional view taken on the line II of a detail shown in FIG. 1, FIG. 3 is a perspective view of a detail of the suspension of the sliding roof, FIG. 4 is a perspective view of part of the swimming pool shown in FIG. 1, FIG. 1 shows a swimming pool comprising a basin 1 with an adjacent building 2. Around the basin 1 is erected a supporting structure. This supporting structure comprises a plurality of vertical elements 3, on which girders 4 are bearing. The guide beams 5 formed by I-section profiles, form part of said girders 4. To the beams 4 are suspended in a manner to be described more fully hereinafter a plurality of I-section beams 6. The beams 6 are interconnected by layers of cloth 7 and 8 so that a chamber is formed between every two beams, the boundaries being thus formed by the beams 6 and the layers of cloth 7 and 8. The beams 6 are adapted to be displaced in the transverse direction from the position shown in FIG. 2, in which the beams 6 and the layers of cloth 7 and 8 are completely housed inside a U-shaped chamber 9, into a position shown in FIG. 1, in which the sliding roof formed by the layers of cloth 7 and 8 covers the whole basin 1. With the aid of a compressor 10 shown in FIG. 2 air is blown into the chambers located between the layers of cloth 7 and 8 so that the layers of cloth 7 and 8 between two adjacent beams 6 become bulging. By allowing the air to flow out of the roof and by shifting the beams 6 into the position shown in FIG. 2, the sliding roof is opened.

Hereinafter the construction of the roof will be set out in further detail.

It will be apparent from FIG. 3 that the beam 6 is suspended to the flange 11 of the guide beam 5. Supports 12 fastened to the beam 6 accommodate rollers 13 and 14, which co-operate on either side of the beam 5 with the lower limb of said beam. The supports 12 are connected with each other by cables 15. The first beam 16 is constructed in the form of a box-shaped profile and comprises widened supports 17, which are adapted to co-operate through a double set of rollers with the flange 11 of the beam 5. Owing to the double set of rollers an out-of-line movement is avoided. On the top side the support 17 is provided with a projecting part 18, which is coupled with chains 19. These chains are passed around a chain sprocket 120, which is driven by an electric motor 121. Owing to the double set of rollers the part 18 cannot topple over. The beams 6 are coupled with each other and with the first beam 16 by means of cables 20. The layers of cloth 7 and 8 are fixed to the beams 6 with the aid of clamping plates 21 and 22 respectively. To the beam 16 also the layers of cloth 7 and 8 are fastened by means of clamping plates. The webs of the beams 6 have openings 23 so that the chambers formed by the beams 6 and 16 and the layers of cloth 7 and 8 are in open communication with each other. The layers of cloth 7 and 8 at the end remote from the furst beams 16 are fastened not only to the beam 6 but also to the end wall 24 of the chamber 9. The compressor 10 communicates through a duct 25 with the opening 26 in the wall 24. The duct 25 can furthermore be connected through an opening 27 with the surroundings by displacing a flap 28. On the suction side the compressor 10 communicates with the surroundings through a duct 29 and with the duct 30, which joins the opening 26. The duct 29 may be connected at will by means of the flap 31 with the suroundings or with the duct 30. The opening 26 may communicate at will be means of a flap 32 with the duct 30 or with the duct 25. The duct 25 includes a device 33 for heating the air passing through the duct 25. By setting the flaps 28, 31 and 32 air can be pressed at will with the aid of the compressor 10 through the opening 26 into the chambers formed by the layers of cloth 7 and 8 or be withdrawn therefrom. The beam 16 is provided on the outer side with brackets 34 having cam faces 35. With these cam faces are adapted to co-operate hooklike lock bolts 36. The lock bolts 36 are pivotally connected by means of shafts 37, journalled in consoles 38 forming part of the stationary supporting structure. With the aid of control-rods 39 the lock bolts 36 can be actuated from the ground.

With the aid of plates 40 fastened to extension arms 41 and to the rims of the upper limbs of the beam 5 the driving mechanism of the beams 6 and 16 is screened from sight.

FIGS. 1 and 4 show that also the sidewalls may be constructed in a similar manner as the roof. In this case additional connections have to be provided for the supply of air to the chambers forming the sidewalls.

When the roof has to be moved from the open position into the closed state, first the beam 16 is moved out of the chamber 9 with the aid of the motor 121. The beams 6 are then successively drawn on via the cables 15 and 20. When the beam 16 is in the extreme position it is fixed in place with the aid of the lock bolt 36. Then, with the aid of the compressor 10, air is sucked in and pressed through the opening 26 into the chambers formed between the layers of cloth 7 and 8. When a sufficient quantity of air has been supplied, the roof has the shape shown in the drawing.

It is also possible to provide a locking device midway the opening to be covered so that the roof can be opened by half. It is then necessary to provide the possibility of locking, for example, half the number of beams 6 inside the chamber 9. By slightly inclining the positions of the beams 6 a slightly sloping gutter may be formed between the layers of cloth 7 so that rain falling on the roof can be readily drained. The layers of cloth 8 may be provided at the lowermost point with a tapping opening for conducting away condensed water, if it has been formed inside the chambers.

What I claim is:

1. In combination with a building structure having a supporting framework having roof opening of predetermined length and width and a series of fixed parallel supports within said opening, a sliding roof structure adapted selectively to cover and uncover said roof opening, said roof structure comprising:

a plurality of parallel beams spanning said roof opening and disposed transverse to and below said fixed supports, said beams being constructed of rigid material such as metal;

means slidably suspending the said beams from said fixed beams supports for movement between a retracted position in which the beams are crowded together at one end of said roof opening and an exended position in which the beams are spaced apart throughout the length of said roof opening;

upper flexible covering means connecting adjacent pairs of beams for allowing relative movement therebetween and lower flexible covering means connecting adjacent pairs of beams for allowing relative movement therebetween, each said flexible covering means being of gas-tight material to define a chamber between each adjacent pair of beams and means for closing each end of each chamber whereby said roof structure is essentially airtight;

means for selectively filling said chambers with gas and discharging gas therefrom whereby each covering means is ballooned out between each adjacent pair of beams when the roof structure is extended and each covering means is flaccid to permit the retracted positioning of said beams; and means for physically displacing only the leading one of said beams, and flexible connecting means joining each adjacent pair of beams for displacing all but the last of said beams in train-like fashion behind said leading beam.

2. In the combination as defined in claim 1 wherein said means slidably supporting comprises a plurality of trolleys on each beam suspending each beam from said fixed supports.

3. In the combination as claimed in claim 1 characterized in that at the end of the opening to be covered remote from the first beam a U-shaped chamber is provided to accommodate the joined beams and the freely hanging layers of flexible covering means.

4. In the combination as claimed in claim 3 characterised in that the compressor communicates with the chamber adjacent the fixed end of the sliding roof and in that openings are provided in the partition between every two adjacent chambers.

5. In the combination as claimed in claim 4 characterised in that the compressor communicates through a set of ducts including flaps with the first chamber so that by means of the flaps the compressor can feed air into the chambers and withdraw air therefrom.

6. In the combination as claimed in claim 5 characterised in that the ducts connected with the compressor for the supply of the gas to the chambers include a heating device.

7. In the combination as claimed in claim 1 characterized in that the supporting beams are held so that they are in slightly inclined position so that between the top sides of the adjacent chambers a sloping gutter is formed.

8. In the combination as claimed in claim 7 characterised in that the chambers are provided in the lower side at the lowermost point with a tapping opening for condense water, which can be closed.

* * * * *